US006247341B1

(12) United States Patent
Prevot et al.

(10) Patent No.: US 6,247,341 B1
(45) **Date of Patent: *Jun. 19, 2001**

(54) LOCK FOR SLIDING DOOR, WINDOW OR LIKE CLOSURE

(75) Inventors: Gérard Prevot, Willerwald; Gérard Desplantes, Sarrebourg; Eric Alvarez, Hommert, all of (FR)

(73) Assignee: Ferco International Ferrures et Serrures de Batiment, Reding (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/054,911

(22) Filed: Apr. 3, 1998

(30) Foreign Application Priority Data

Apr. 3, 1997 (FR) ..... 97 04064

(51) Int. Cl.[7] ..... E05B 65/06

(52) U.S. Cl. ..... 70/101; 70/95; 70/97; 70/90; 292/DIG. 46

(58) Field of Search ..... 70/101, 89, 90, 70/95–100; 292/150, 153, DIG. 20, DIG. 46

(56) References Cited

U.S. PATENT DOCUMENTS

| | | | | |
|---|---|---|---|---|
| 3,050,322 | | 8/1962 | Miller | 292/114 |
| 3,390,557 | * | 7/1968 | Erickson et al. | 70/97 |
| 4,024,739 | * | 5/1977 | Kaufman | 70/97 |
| 4,428,605 | | 1/1984 | Follows | 292/152 |
| 4,436,329 | * | 3/1984 | Metzger | 292/DIG. 46 X |
| 4,790,157 | * | 12/1988 | Lin | 70/95 |
| 5,074,133 | * | 12/1991 | Simoncelli | 70/90 |
| 5,511,833 | * | 4/1996 | Tashman et al. | 70/95 X |

FOREIGN PATENT DOCUMENTS

| | | |
|---|---|---|
| 0 044 264 | 1/1982 | (EP) . |
| 2 700 577 | 7/1994 | (FR) . |
| 2 115 063 | 9/1983 | (GB) . |

* cited by examiner

*Primary Examiner*—Suzanne Dino Barrett
(74) *Attorney, Agent, or Firm*—Kenyon & Kenyon

(57) ABSTRACT

In a lock for sliding door, window or like closure the slider has on its face adjacent the outside wall of the casing a member projecting a predetermined distance which projects through the slot in the locked position of the slider and abuts against the edge surface of the outside wall defining the longitudinal end of the slot. A return spring between the slider and the casing spring-loads the slider towards the outside wall of the casing but allows movement of the slider in the direction perpendicular to the outside wall over a distance at least equal to the predetermined distance.

11 Claims, 5 Drawing Sheets

46
48
51
46a
51a
81
83
51d
49d
82
80
50b
50
50a
47

81
83
47
46
51
48
51a
51d
80
A
82
46a
50
50a
49c 51d
46a
48
46
51a
81
83
47
82
49b
50
50a
80

81
47
51
46a
48
46
51d
49a
83
80
13
82
50b
50
50a
5

LOCK FOR SLIDING DOOR, WINDOW OR LIKE CLOSURE

BACKGROUND OF THE INVENTION

1. Field of the Invention

The present invention concerns a lock for sliding door, window or like closures.

2. Description of the Prior Art

FR-A-2 590 309 discloses a lock for a sliding door, window or like closure comprising, inside a casing, a slider mobile in the longitudinal direction of the casing and carrying a bolt-carrier, means for immobilizing the slider relative to the casing in the locked position of said slider and means for releasing the slider from its locked position, the slider including maneuvering member means accessible through a longitudinal slot in the outside wall of the casing.

According to the above document, the slider is immobilized relative to the casing in the locked position of the slider by a ratchet having at least one projecting tooth and actuated by a maneuvering member fastened to the slider. To release the ratchet there is a "dead" travel of the slider before the bolt is entrained.

A ratchet device of the above kind is costly and complicated.

The aim of the present invention is to remedy the drawbacks of prior art locks and to propose a lock of the above type that is simple, economical and reliable.

SUMMARY OF THE INVENTION

In accordance with the present invention, in a lock of the above type the slider has on its face adjacent a covering plate of the casing a member projecting a predetermined distance relative to the adjacent face, the projecting member being adapted to project through the slot in the locked position of the slider and abut against an edge of the covering plate defining the longitudinal end of the slot that is at the rear in terms of the locking direction, and return spring means between the slider and the casing spring load the slider towards the covering plate of the casing but allow movement of the slider in a direction perpendicular to the covering plate over a distance at least equal to the predetermined distance.

Accordingly, when the slider, actuated by the maneuvering member, reaches its locked position the projecting member is in front of the slot in the casing and is made to enter this slot by the return spring means.

To release the slider it is sufficient to exert a slight force on the maneuvering member in the direction perpendicular to the covering plate of the casing to move the maneuvering member and the slider in this direction towards the inside of the casing a distance at least equal to the predetermined height of the projecting member. This releases the projecting member from the edge defining the corresponding end of the slot and the maneuvering member and the slider are then moved in the longitudinal direction of the casing to unlock the closure.

In an advantageous version of the invention the casing comprises an extrusion or like member having two substantially parallel lateral longitudinal walls projecting on the same side relative to the cover plate, each lateral longitudinal wall having on its respective longitudinal edge opposite the covering plate a respective longitudinal rim extending transversely towards the other lateral wall over at least part of the transverse dimension of the casing, and the slider has at least one lug adapted to bear elastically on at least one of the rims of the casing.

In a preferred version of the invention the slider includes means adapted to cooperate with complementary means of the casing to render the unlocked and locked positions of the slider precise stable positions by elastically opposing with a predetermined force any movement of the slider either way in the longitudinal direction from one or other of said stable positions, where applicable assisting movement of the slider to the opposite stable position on moving past an unstable middle position.

Other features and advantages of the invention will become apparent in the following detailed description given by way of non-limiting example only with reference to the appended drawings.

DETAILED DESCRIPTION OF THE PREFERRED EMBODIMENTS

Figure 1:
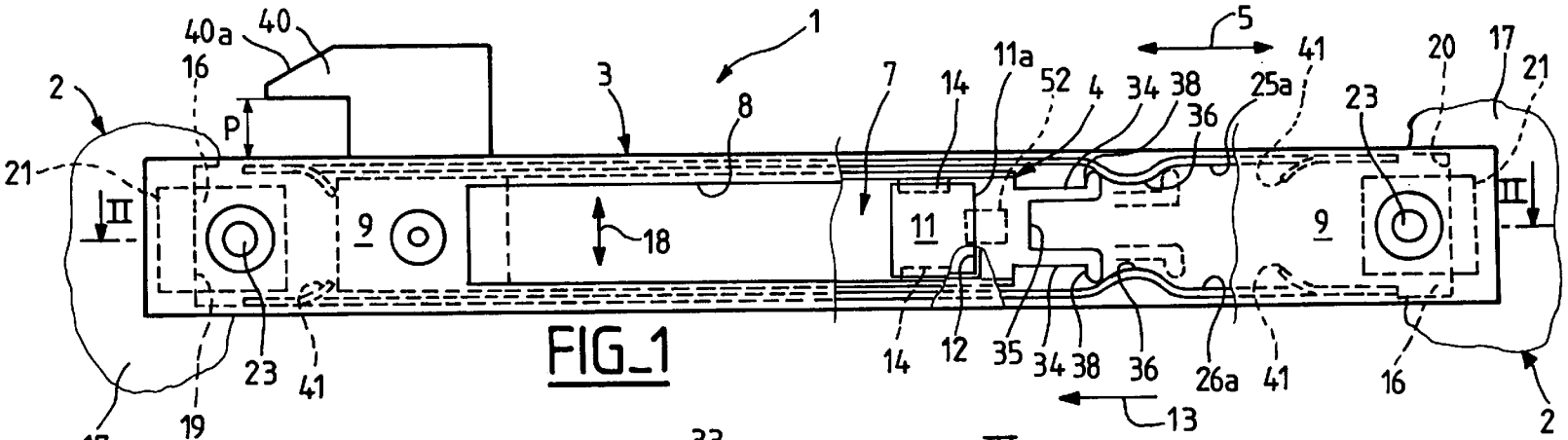
FIG. 1 is a cut away front view of one embodiment of a lock in accordance with the present invention showing the slider in its locked position.

In the embodiment shown in FIGS. 1 through 6 the lock 1 for a sliding door, window or like closure 2 comprises, inside a casing 3, a slider 4 mobile in the longitudinal direction 5 of the casing 3 and carrying a bolt-carrier 6, means for immobilizing the slider 4 relative to the casing 3 in the locked position of said slider 4 and means for releasing the slider 4 from its locked position. The slider 4 includes maneuvering member means 7 accessible through a longitudinal slot 8 in the covering plate 9 of the casing 3.

The slider 4 has on its face 10 adjacent the cover plate 9 of the casing 3 a projecting member 11 having a predetermined height C relative to said adjacent face 10. The projecting member 11 is adapted to project through the slot 8 in the locked position of the slider 4 and abuts against the edge surface 12 of the cover plate 9 that defines the longitudinal end of the slot 8 that is the rear end in terms of the locking direction 13 of the slider (see FIG. 2).

Figure 2:
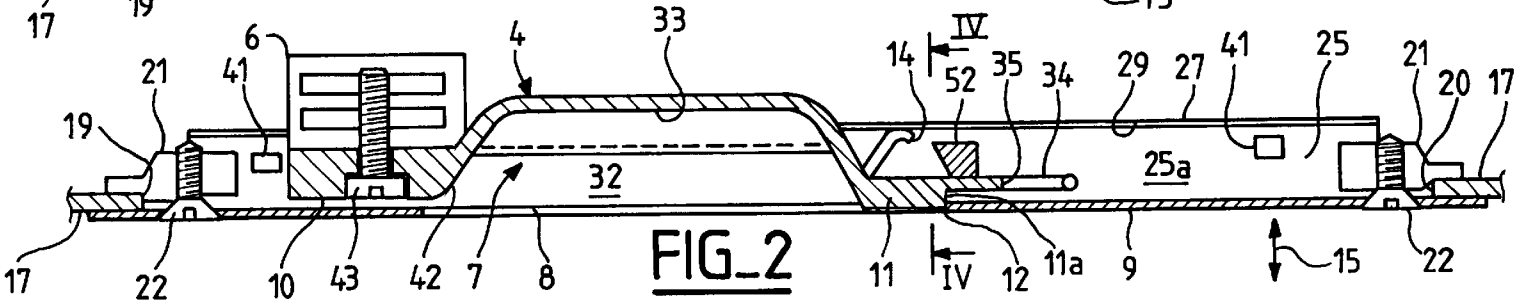
FIG. 2 is a view in section taken along the line II—II in FIG. 1 showing the slider in its locked position.

To be more precise, the transverse face 11*a* of the projecting member 11 facing the opposite way to the locking direction 13 has an edge surface 11*a* that engages with the edge surface 12 in the locked position of the slider 4 (see FIG. 2). The member 11 therefore constitutes an anti-break-in device and immobilizes the slider 4 in its locked position.

Return spring means 14 between the slider 4 and the casing 3 spring-load the slider 4 towards the covering plate 9 of the casing 3 but allow the slider 4 to move in the direction 15 perpendicular to the covering plate 9 a distance at least equal to said predetermined height C. This enables the projecting member 11 to be pushed inside the casing 3 to release the slider 4 from its locked position, the projecting member 11 then sliding along the inside face 9*a* of the covering plate 9 of the casing 3. The distance C is substantially equal to the thickness of the wall 9, for example. This releases the anti-break-in member 11.

In the conventional way, and as shown diagrammatically in FIGS. 1 through 4, the casing 3 is introduced into an elongated opening 16 in the inside wall 17 of the sliding closure 2.

The sliding closure 2 is a conventional closure comprising frames made from aluminum or other material extrusions.

The covering plate 9 of the casing 3 covers the opening 16 entirely. The casing 3 is fixed to the inside wall 17 of the closure in a conventional way: each transverse edge 19, 20 of the opening 16 is gripped between the covering plate 9 of the casing 3 and a fixing member 21 by means of a fixing screw 22 introduced from the covering plate of the casing 3 into a hole 23 in the outside 9 (see FIGS. 1 to 3).

Figure 4:
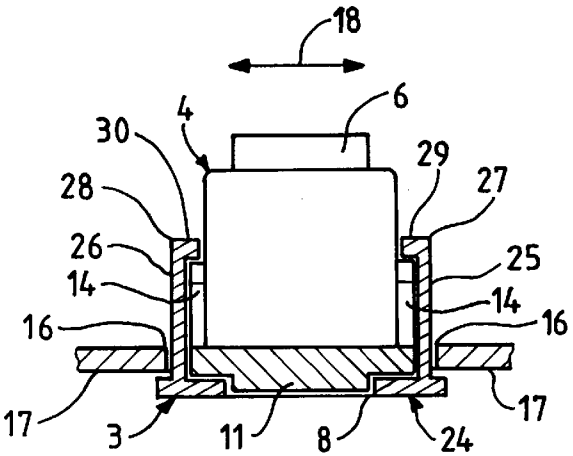
FIG. 4 is a diagrammatic view in section taken along the line IV—IV in FIG. 2.

In the present example, and as shown in detail in FIG. 4, the casing 3 comprises an extrusion 24 having two substantially parallel lateral longitudinal walls 25, 26 projecting from the same side of the covering plate 9. Each lateral longitudinal wall 25, 26 has on its longitudinal edge 27, 28 opposite the covering plate 9 a longitudinal rim 29, 30 extending transversely towards the other lateral wall 26, 25.

The longitudinal rims 29, 30 extend transversely over at least part of the transverse dimension of the casing and can merge to form a solid wall forming a back wall of the casing 3.

As shown in the figures, the slider 4 has two lateral lugs 14 each adapted to bear elastically on the corresponding rim 29, 30 of the casing 3.

The lugs 14 are made in any manner known in itself. They can be fixed to the slider 4 in any manner, for example by welding or brazing. They can equally be cast in one piece with the slider 4.

In the example shown the slider 4 has in its middle part maneuvering member means 7 consisting of a recess 32 the concave side of which faces the slot 8 in the covering plate 9 of the casing 3.

The recess 32 can be formed by molding or by bending, for example. It provides a passage for the user to insert their fingers through the slot 8 to apply a longitudinal force to the bottom wall 33 of the recess 32 to move the slider 4 one way or the other in the longitudinal direction 5 of the casing and to apply a force in the direction 15 perpendicular to the covering plate 9 of the casing 3 to release the slider 4 from its locked position.

The slider 4 includes means 34 adapted to cooperate with complementary means 36 of the casing 3 to render the locked position and an end position opposite the locked position of the slider 4 precise and stable by elastically opposing with a predetermined force any displacement of the slider 4 either way in the longitudinal direction 5 from one or other of said stable positions, where applicable assisting the movement of the slider 4 to the opposite stable position in the event of passing beyond an unstable or substantially unstable middle position.

In this example the slider 4 has two fingers 34 projecting longitudinally from one end 35 of the slider 4. Each of the lateral longitudinal walls 25, 26 of the casing 3 has an enlargement 36 projecting towards the inside of the casing 3 relative to the wall 25, 26. Each enlargement 36 is arranged so that a feeler 38 at the free end of the corresponding finger 34 and projecting towards the corresponding wall 25, 26 of the casing 3 relative to the finger 34 is on a respective side of said enlargement 36 in the stable unlocked and locked positions of the slider 4, respectively.

On departing from either of the two stable positions of the fingers 34, i.e. the immobilized locked position shown in full line in FIG. 1 or the released position shown in dashed line in that figure, each enlargement 36 therefore constitutes a first ramp on passing over which the fingers 34 must retract elastically when the slider 4 moves from either of said stable positions to an unstable or substantially unstable middle position, then a second ramp on which the fingers 34 bear elastically when the slider 4 moves from this middle position to the opposite stable position.

The instability of the middle position is due to the presence of the enlargements 36 and to the elastic force exerted on the enlargements by the fingers 34.

The means just described oppose any unintentional movement of the slider 4 in the longitudinal direction.

As shown in FIG. 1 in particular the enlargements 36 are formed by deforming the lateral longitudinal walls 25, 26 of the casing 3 towards the inside of the casing 3, for example. This deformation is a plastic deformation and is easily obtained if the casing 3 is a light alloy or plastics material extrusion 24.

Abutment means 41 are formed on the inside face 25*a*, 26*a* of at least one lateral longitudinal wall 25, 26 of the casing 3 after the slider 4 is inserted in the casing 3 to limit the travel of the slider 4 at least one way inside the casing 3.

There is preferably an abutment 41 on each longitudinal wall 25, 26 of the casing 3 near each longitudinal end of said casing 3. The abutments are made in any manner known in itself, for example by punching a tongue directed towards the inside of the casing in each of the lateral longitudinal walls 25, 26 of the latter.

In the example shown, the slider 4 carries a bolt-carrier 6 near the end 42 of the maneuvering member 7 opposite the projecting member 11. The length L of the slot 8 (see FIG. 7) and the position of the bolt-carrier 6 are predetermined so that a screw 43 for immobilizing the projection P of the bolt 40 (see FIG. 1) is accessible via the slot 8 in the unlocked position of the slider 4 shown in FIG. 3.

Figure 7:
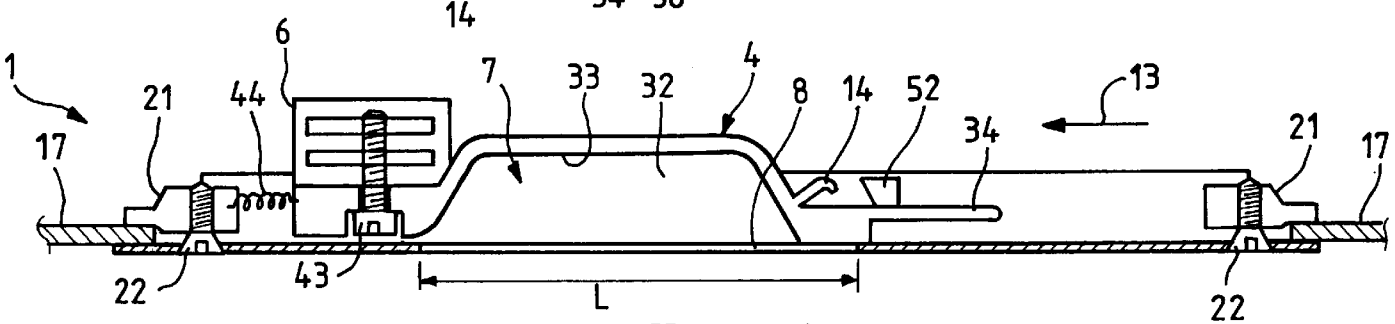
FIG. 7 is a diagrammatic view similar to FIG. 2 of another embodiment of the invention.
Figure 8:
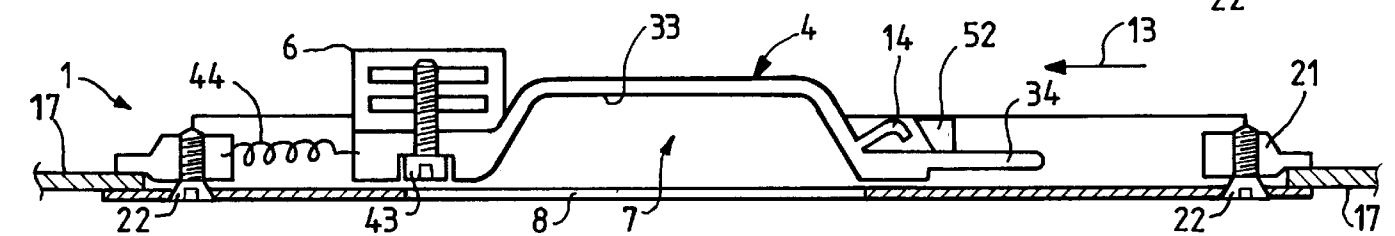
FIG. 8 is a diagrammatic view similar to FIG. 3 of the FIG. 7 embodiment.

In the embodiment of FIGS. 7 and 8 spring means 44 between the casing 3 and the slider 4 spring-load the slider 4 towards its locked position (FIG. 7). Thus the slider 4 is moved automatically towards its locked position.

The movement of the slider 4 by the spring 44 can be stopped before it reaches the locked position, as shown in FIG. 7, to require manual intervention to reach the locked position and immobilize the slider 4 in that position.

In this way, if the closure is being closed, the chamfer 40*a* on the bolt 40 bearing on the striker (not shown) pushes the bolt 40 and the slider 4 in the unlocking direction against the action of the spring 44. The latter automatically returns the slider 4 and the bolt 40 to the position shown in FIG. 7, which is near but not the same as the immobilized locked position of FIGS. 1 and 2.

Indexing means of any kind (stamping, ramp cooperating with the finger 34, etc) are provided to stop the slider 4 in this position.

This operation is therefore possible without risk of damaging the striker and/or the bolt. However, manual maneuvering of the slider 4 is necessary to place the slider 4 in its locked position to obtain the anti-break-in effect of the present invention.

The spring 44 can equally be rated to return the slider 4 automatically to its locked position. In this case an anti-misoperation device of any type has to be provided to detect the proximity of the frame and to unlock the slider before misoperation of the closure damages the striker and/or the bolt.

An anti-misoperation device of this kind is needed only in the case of an automatic lock fitted with an anti-break-in device.

Figure 9:
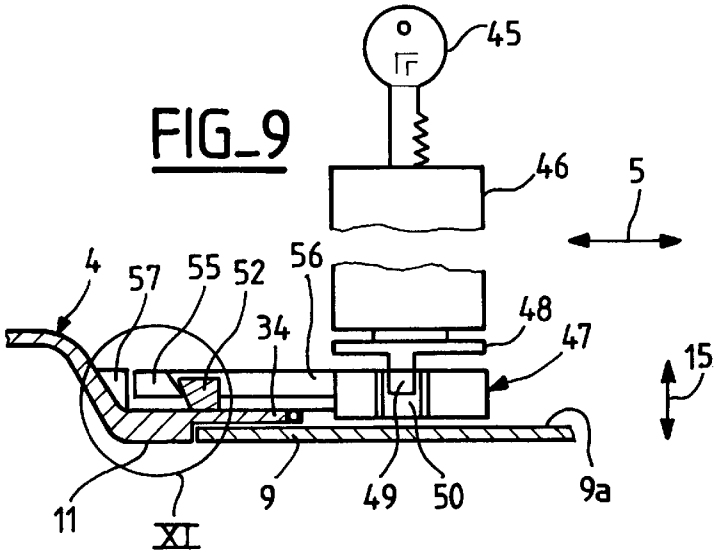
FIG. 9 is a view to a larger scale of part of FIG. 2 in a different embodiment of the present invention including a lock in the plane of the figure.
Figure 10:
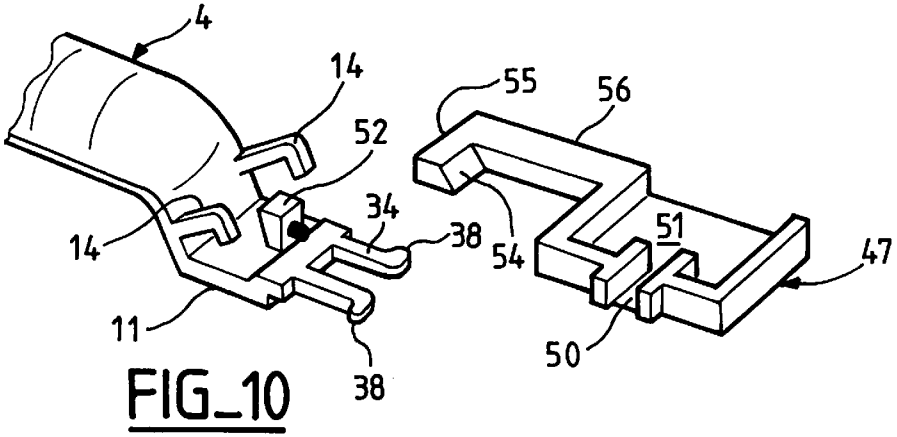
FIG. 10 is an exploded perspective view of the embodiment shown FIG. 9.
Figure 11:
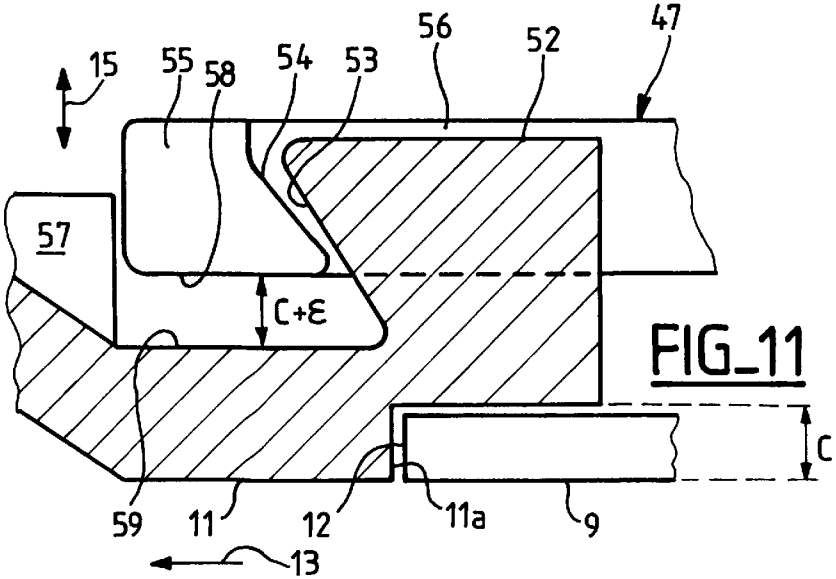
FIG. 11 is a view to a larger scale of the detail XI from FIG. 9.
Figure 6:
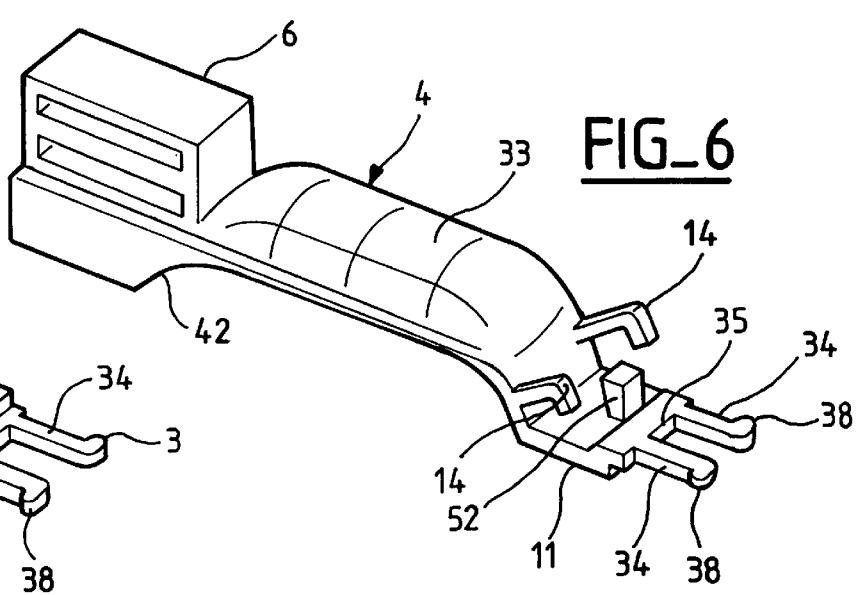
FIG. 6 is a view similar to FIG. 5 showing the maneuvering member directed downwards.

In the embodiment shown in FIGS. 9 through 11 the anti-break-in device 11 can be released from outside the closure 2 using a key 45 operating through a lock 46 a drive member 47 for the slider 4. In this example the member 47 is adapted to slide along the inside face 9*a* of the covering plate 9.

In the example shown the lock 46 is a cylinder lock terminating axially in a disk 48 carrying a maneuvering finger 49 adapted to engage in a housing 50 in the drive member 47.

The actuator member 47 has an opening 51 allowing the finger 49 to move on the axis of the housing 50 and on respective opposite sides of this axis parallel to the wall 9.

FIGS. 12A through 12D are diagrams showing the various positions of the finger 49 relative to the opening 51 during the various phases of an unlocking operation.

In the locked position (FIG. 12A) the drive member 47 has been moved in the locking direction 13, towards the left in the figure, and the finger 49 occupies the relative position 49*a* near the wall 51*a,* disengaged from the walls of the housing 50. The finger 49 in position 49*a* abuts against a wall element 80 parallel to the direction 5.

Figures 12A, 12B, 12C, 12D:
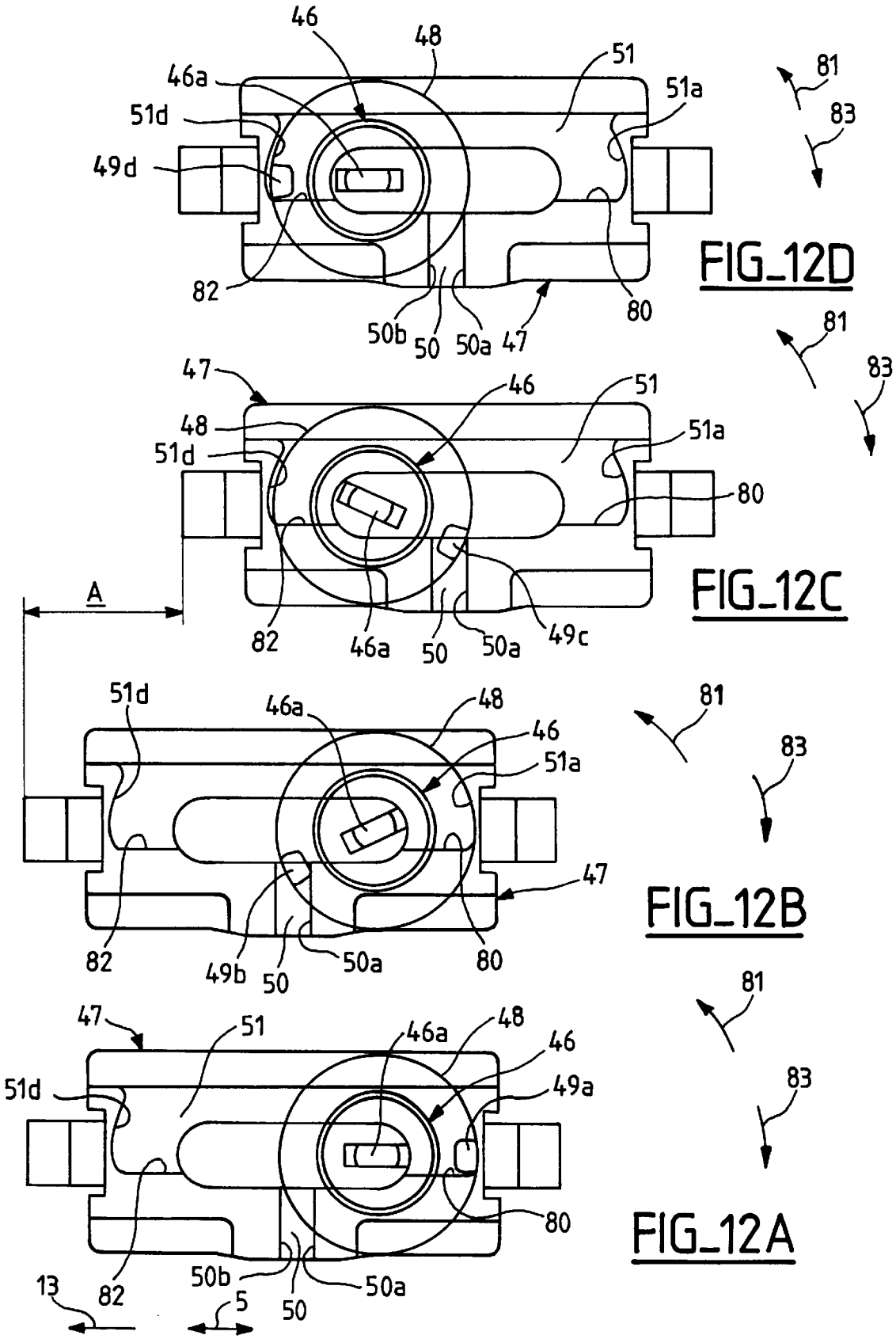
FIGS. 12A through 12D are top views to a larger scale of the drive member from the embodiment of FIGS. 9 through 11 showing the various phases of an unlocking operation in which the lock cylinder is respectively shown in its starting position (0°) and after rotating 205°, 335° and 540°.

In the situation represented in FIG. 12B the cylinder 46*a* of the lock 46 has turned 205° in the unlocking direction 81, which is the anticlockwise direction in the figure. The finger 49 in position 49*b* enters the housing 50. The drive member 47 has not yet moved.

Figure 3:
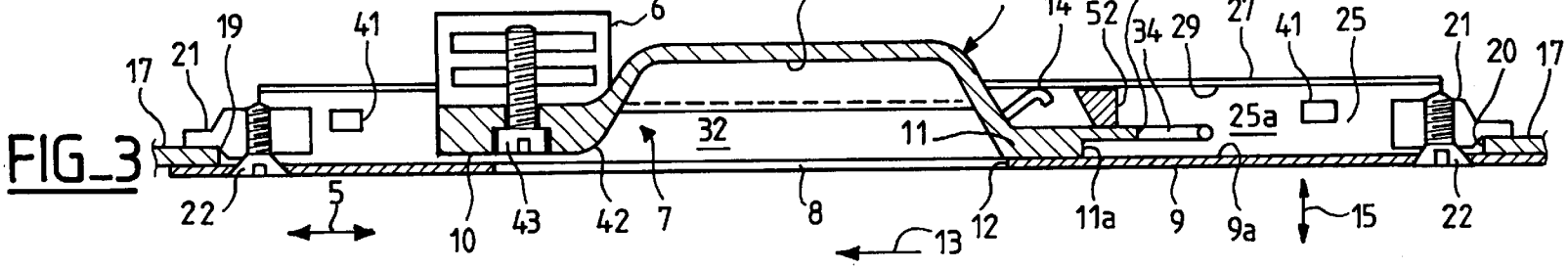
FIG. 3 is a view similar to FIG. 2 showing the slider in its unlocked position.

In the situation represented in FIG. 12C the cylinder 46*a* has turned a total of 335° in the direction 81 from the FIG. 12A position. During rotation from 205° to 335° the finger 49 has remained trapped in the housing 50 and has pushed the wall 50*a* towards the right in the figure to move the drive member 47 in the unlocking direction, i.e. in the direction opposite the locking direction 13, towards the right in the figure, a distance A equal to the sliding travel of the bolt 40 between its locked position (FIG. 2) and its unlocked position (FIG. 3). The finger 49 is at this time in position 49*c* in which it is disengaged from the wall 50*a*.

In the situation represented in FIG. 12D the cylinder 46*a* has turned a total of 540° and the finger 49 is in position 49*d* abutted against the wall 51*d* opposite the wall 51*a* and against the wall 82 extending the wall 80.

In this last phase the drive member 47 has remained in its unlocked position without moving.

Thus the slider 4 has been released manually by means of the lock 46 and has been moved to its unlocked position (there is no spring 44). The finger 49 has moved to the relative position 49*d,* near the wall 51*d,* disengaged from the walls of the housing 50, which corresponds to the unlocked position of the slider, and abuts against the wall 82 parallel to the direction 5.

For the reverse locking maneuver the cylinder 46*a* is turned in the opposite direction 83. The finger 49 leaves position 49*d* to move to position 49*c* in which the wall 50*a* allows it to enter the housing 50 where it abuts against the wall 50*b*. In rotating from 335° to 205° the finger 49 moves from position 49*c* to position 49*b* and pushes the wall 50*b* and the whole of the drive member 47 the same distance A in the locking direction 13, towards the left in the figure. In position 49*b* the finger 49 is disengaged from the wall 50*b,* leaves the housing 50 and can return freely to position 49*a*.

To enable release of the slider 4 from its locked position (FIG. 2) the drive member 47 and the slider 4 include complementary means of conjugate shape adapted to transform movement of the drive member 47 in the longitudinal direction 5 at the beginning of an unlocking operation into movement of the slider 4 in the direction 15 perpendicular to the covering plate 9 of the casing 3.

As shown in detail in FIG. 11 the slider 4 includes a stud 52 the transverse face 53 of which facing in the locking direction 13 of the slider 4 is inclined relative to said perpendicular direction 15 and extends in the locking direction 13 and towards the inside of the casing 3. The drive member 47 has a complementary face 54 inclined in substantially the same direction to move the slider 4 in the direction 15 towards the inside of the casing 3 at the start of an operation to unlock the slider 4 by means of the key 45.

The face 54 of the drive member 47 is part of a lever member 55 carried by an arm 56 of the member 47.

The lever 55 is held between the stud 52 and an abutment 57 of the slider 4 which means that the lever 55 must be inserted transversely relative to the slider 4.

The surface 58 of the lever 55 facing towards the covering plate 9 of the casing faces a corresponding surface 59 of the slider 4.

For the lever 55 acting on the inclined transverse face 53 of the stud 52 to remove the member 11 from its position engaged with the edge surface 12 of the plate 9 the distance between the two surfaces 58 and 59 must be slightly greater than the height C of the area of contact between the edge surface 12 and the shoulder or edge surface 11*a* of the member 11, for example equal to $C+\epsilon$, as shown diagrammatically in FIG. 11.

The lever 55 must also be able to move in the unlocking direction, i.e. in the direction opposite the locking direction 13, a sufficient distance, depending on the inclination of the inclined faces 53 and 54, to raise the stud 52, immobilized in the longitudinal direction, a distance at least equal to $C+\epsilon$.

Figure 13:
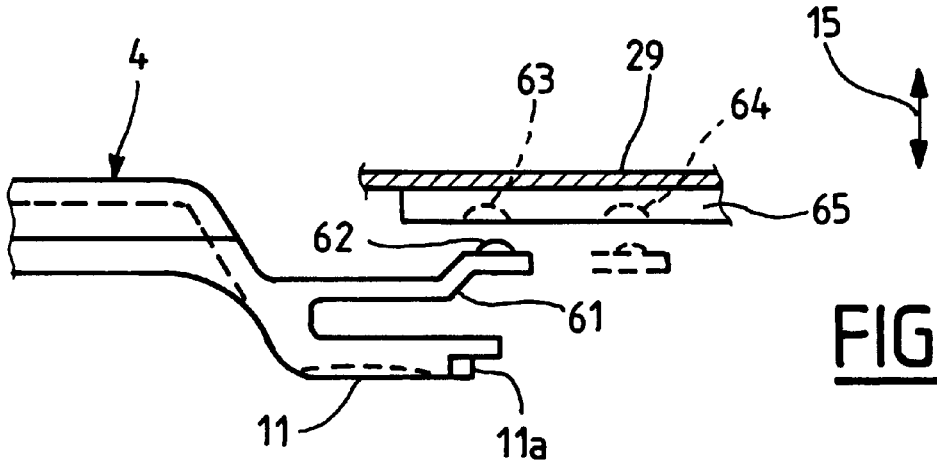
FIG. 13 is a view similar to FIG. 2 of a detail of another embodiment of the present invention.
Figure 14:
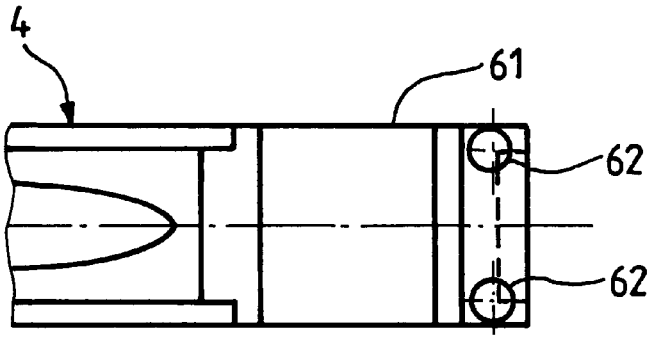
FIG. 14 is a top view of the detail shown in FIG. 13.

FIGS. 13 and 14 show another embodiment of means for spring return of the slider 4 towards the covering plate 9 of the casing 3 and for elastically opposing with a predetermined force of any movement of the slider 4 either way in the longitudinal direction from either of the locked and unlocked stable positions of the slider 4.

To this end the slider 4 has a lug 61 above the member 11 extending in the longitudinal direction 5 of the casing opposite the locking direction 13.

The lug 61 has at least one shaped portion 62 at its free end adapted to engage elastically and respectively in the locked position and in the unlocked position of the slider 4 with complementary shaped portions 63 and 64 attached to or part of the rims 29 and 30 constituting the back of the casing 3.

In the example shown the lug 61 has two shaped portions 62 near respective lateral longitudinal walls 25 and 26 of the casing 3. Here the shaped portions 62 are substantially spherical convex excrescences.

In a complementary way, the rims 29 and 30 each have a shaped portion 63 and a shaped portion 64 which here are in the form of substantially spherical concave recesses.

The shaped portions 63 and 64 are obviously spaced from each other in the longitudinal direction 5 of the casing 3 by a distance corresponding to the travel of the slider 4 between its locked position shown in full line in FIG. 13 and its unlocked position shown in dashed line in the same figure. The shaped portions 63 and 64 are advantageously on arms 65 extending longitudinally under the rims 29 and 30 and fixed to the bottom of these rims in any manner.

The arms 65 can advantageously be part of a fixing member adapted to fix the corresponding end of the casing 3 to the corresponding end of the slot 16 in the wall 17 of the closure.

To make FIG. 13 clearer, the lug 61 is shown in FIG. 13 moved away from the arms 65 in the direction 15. It is clear that in reality the lug 61 bears elastically on these arms.

The slider 4 described hereinabove can advantageously be made by injection molding a heated plastics material. The lug 61 made in this way has sufficient spring return force to implement the functions described hereinabove.

The converse arrangement is obviously possible with convex excrescences on the rims 29 and 30 and complementary concave recesses on the lug 61.

Figure 5:
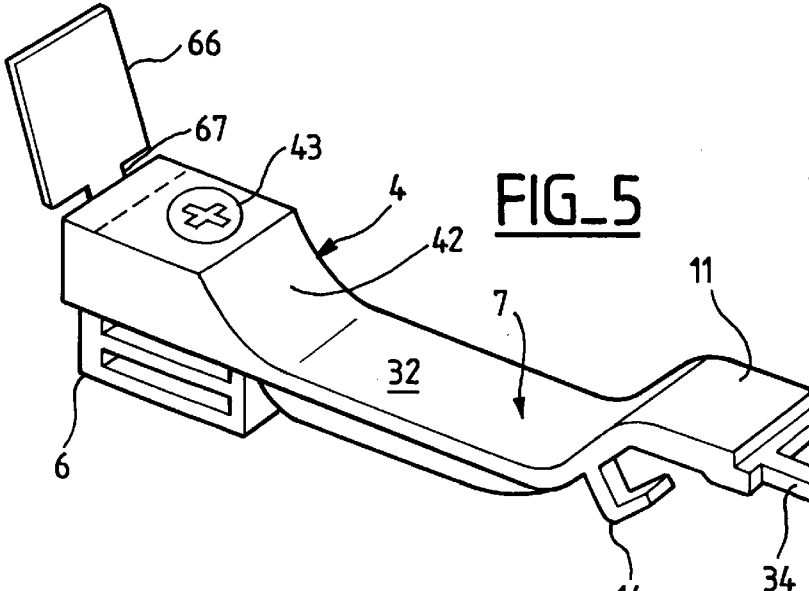
FIG. 5 is a perspective view of the slider of the embodiment from FIGS. 1 through 4 showing the slider with the maneuvering member directed upwards.

As shown in FIG. 5 the head of the screw 43 for immobilizing the bolt 40 can advantageously be concealed by a cover 66.

If the slider 4 is made from plastics material the cover 66 can advantageously be in one piece with the slider 4 to which it can be connected by a hinge 67 consisting of a thinner part of the plastics material. The cover 66 has a rectangular shape matching the rectangular shape of the slot 8 in the lock 1 shown in FIGS. 1 through 6.

Figure 15:
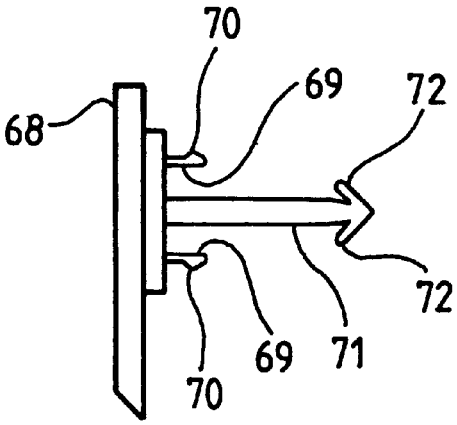
FIGS. 15 and 16 are respectively a profile view and a top view of a variant of the detail from FIG. 5.
Figure 16:
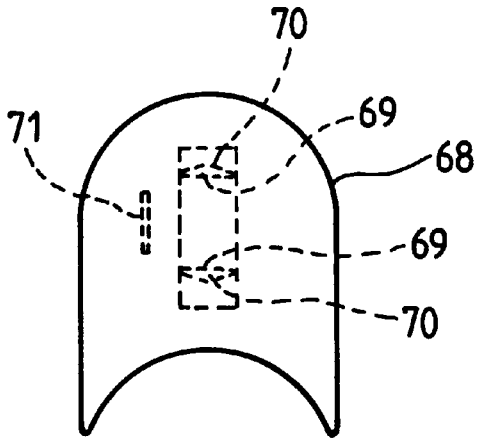

In the embodiment shown in FIGS. 15 and 16 the cover 68 has two parallel rounded transverse ends to suit a slot 8 with semicircular longitudinal ends.

The cover 68 has two claws 69 on its face facing towards the inside of the slider each having a lug 70 adapted to engage with complementary shaped portions, not shown, of the slider to fix the cover 68 removably to said slider 4.

In the example shown the cover 68 also has an elongate finger 71 carrying two tongues 72 at its free end forming an arrowhead adapted to be bent along the finger 71 to enter a complementary hole, not shown, in the slider 4 and to move away from the finger to retain the latter in the hole in order to retain the cover 68 to the slider when turning the screw 43.

FIG. 16 shows that the finger 71 is offset transversely relative to the claws 69, 70.

There has therefore been described a lock with a very simple and economic structure including a much smaller number of components than in the prior art. The lock is therefore particularly reliable whilst conforming to all the functional security criteria imposed on a lock of this kind, which is also compatible with the market requirements for the various aesthetic presentations to be offered to customers.

Of course, the present invention is not limited to the embodiments just described and many changes and modifications can be made to the latter without departing from the field of the invention.

For example, a slider in accordance with the invention can be fitted with a handle of any type other than that described hereinabove, for example a lever, rocker or plunger type handle passing through the slot 8.

Similarly, a slider and a casing can be provided respectively including the fingers 34 and the enlargements 36, or the lug 61 and the shaped portions 62, 63 and 64, with no projecting member 11 adapted to project through the slot 8 in the locked position of the slider 4.

The bolt-carrier 6 and the bolt 40 can be of any type.

The slider 4 includes at least one finger 34 projecting longitudinally from one end 35 of the slider 4 and a corresponding longitudinal wall 25, 26 of the casing 3 has an enlargement 36 projecting inwards relative to the wall 25, 26 and such that a feeler 38 at the end of the finger 34 projecting towards the wall 25, 26 relative to the finger 34 is on respective opposite sides of said enlargement 36 in the unlocked and locked stable positions of the slider 4 and elastically resists contact with the enlargement 36 when the slider 4 moves from one of said stable positions to the other.

The slider 4 includes a lug 61 extending cantilever-fashion from the slider 4 in the longitudinal direction 5 of the casing 3 and the lug 61 has shaped portions 62 facing complementary shaped portions 63, 64 of the rims 29, 30 of the casing adapted to cooperate elastically with said complementary shaped portions 63, 64.

What is claimed is:

1. A lock for a sliding closure having an inside wall, said lock adapted to be introduced in an elongated opening arranged in the inside wall, said lock comprising an elongated casing adapted to be introduced in the elongated opening and having a covering plate including an internal face adapted to be in contact with, and to cover, peripheral edges of the elongated opening, said casing including two substantially parallel longitudinally extending lateral walls projecting from said internal face, said lock further comprising a slider mobile inside said casing in a longitudinal direction of said casing between said internal face of said covering plate and said lateral walls and carrying a bolt carrier, said slider comprising a maneuvering member means accessible through a longitudinal slot arranged in said covering plate and means for immobilizing said slider relative to said casing in a locked position of said slider and means for releasing said slider from said locked position, wherein said slider has on a face thereof adjacent said internal face of said covering plate a member projecting a predetermined distance relative to said adjacent face, said projecting member shaped in such a manner that it is adapted to slide against said internal face of said covering plate when said slider slides longitudinally inside said casing and to protrude through a corresponding end of said slot when said slider is in said locked position, thereby blocking said slider in said locked position, said slider having cantilevered lug means extending cantilever-fashion from said slider in said longitudinal direction and adapted to slidingly and elastically bear against complementary conformations fixed in said casing in order to permanently and resiliently urge said slider against said internal face of said covering plate but allow movement of said slider in an inward direction inside said casing over a distance at least equal to said predetermined distance in order to release said projecting member from a protruding position thereby releasing said slider from said locked position.

2. The lock claimed in claim 1, wherein each one of said lateral longitudinal walls has on a respective longitudinal edge thereof opposite said covering plate a respective longitudinal rim extending transversely towards an other one of said lateral walls over at least part of a transverse dimension of said casing, and wherein said cantilever lug means are adapted to bear elastically on at least one of said rims of said casing.

3. The lock claimed in claim 1 wherein said slider includes means adapted to cooperate with complementary means of said casing to render said locked position of said slider a precise first stable position and an end position opposite said locked position of said slider a precise second stable position by elastically opposing with a predetermined force any movement in said longitudinal direction of said slider from one of said first or second stable positions to another of said first or second stable positions and assisting movement of said slider to an opposite stable position on moving past an unstable middle position.

4. The lock claimed in claim 3 wherein said slider has at least one finger projecting longitudinally from one end of said slider and wherein a corresponding longitudinal lateral wall of said casing has an enlargement projecting in an inward direction from said wall and such that a feeler at an end of said finger and projecting towards said wall relative to said finger is on respective opposite sides of said enlargement in said first stable position and said second stable position of said slider and elastically opposes contact with said enlargement when said slider moves from one of said first or second stable positions to another of said first or second stable positions.

5. The lock claimed in claim 4 wherein said enlargement is obtained by inwardly deforming said lateral longitudinal wall of said casing.

6. The lock claimed in claim 1 wherein said lug means has shaped portions facing said complementary conformations fixed in said casing and adapted to cooperate elastically with said complementary conformations.

7. The lock claimed in claim 1 wherein abutment means are formed on an inside face of at least one of said lateral longitudinal walls of said casing after insertion of said slider into said casing to limit travel of said slider at least one way inside said casing.

8. The lock claimed in claim 1 wherein said bolt-carrier is carried on said slider near an end of said maneuvering member means opposite said projecting member and a length of said slot and a position of said bolt-carrier are predetermined so that a screw for immobilizing a projection of a bolt of said bolt-carrier is accessible through said slot in an end position of said slider, said end position opposite said locked position.

9. The lock claimed in claim 1 including spring means between said casing and said slider to spring-load said slider in a direction towards said locked position.

10. The lock claimed in claim 1 wherein said slider can be unlocked from an outside of said closure using a key actuating a drive member for said slider and wherein said drive member and said slider have complementary means with conjugate shapes adapted to transform movement of said drive member in said longitudinal direction at a beginning of an unlocking operation into movement of said slider in a direction perpendicular to said covering plate of said casing towards an inside of said casing.

11. The lock claimed in claim 10 wherein said slider includes a stud having a transverse face facing in a locking direction of said slider and inclined relative to said perpendicular direction and extending in said locking direction and towards the inside of said casing and said drive member has a complementary face inclined in substantially a same direction as said transverse face of said stud so as to move said slider in a direction towards the inside of said casing at the beginning of the operation to unlock said slider using said key.

* * * * *